US012534901B2

(12) United States Patent
Zavitz et al.

(10) Patent No.: US 12,534,901 B2
(45) Date of Patent: Jan. 27, 2026

(54) APPARATUSES AND METHODS FOR CONSTRUCTING A CONCRETE STRUCTURE USING PRECAST CONCRETE COMPONENTS

(71) Applicant: Tindall Corporation, Spartanburg, SC (US)

(72) Inventors: Bryant Zavitz, Dunwoody, GA (US); Kevin Kirkley, Dunwoody, GA (US); Chris Detleve Sigmon, Decatur, GA (US)

(73) Assignee: Tindall Corporation, Spartanburg, SC (US)

( * ) Notice: Subject to any disclaimer, the term of this patent is extended or adjusted under 35 U.S.C. 154(b) by 402 days.

(21) Appl. No.: 18/034,935

(22) PCT Filed: Oct. 28, 2021

(86) PCT No.: PCT/US2021/056931
§ 371 (c)(1),
(2) Date: May 2, 2023

(87) PCT Pub. No.: WO2022/094007
PCT Pub. Date: May 5, 2022

(65) Prior Publication Data

US 2023/0417041 A1 Dec. 28, 2023

Related U.S. Application Data

(60) Provisional application No. 63/108,710, filed on Nov. 2, 2020.

(51) Int. Cl.

| | |
|---|---|
| ***E04C 5/08*** | (2006.01) |
| ***E04B 1/21*** | (2006.01) |
| *E04C 5/10* | (2006.01) |

(52) U.S. Cl.
CPC . *E04B 1/21* (2013.01); *E04C 5/10* (2013.01)

(58) Field of Classification Search
CPC ... E04B 1/21; E04B 5/046; E04C 5/08; E04C 3/20; E04C 3/34
See application file for complete search history.

(56) References Cited

U.S. PATENT DOCUMENTS 3,613,325 A * 10/1971 Yee ..... E04B 1/20 52/236.8
4,081,935 A * 4/1978 Wise ..... E04B 5/43 52/432

(Continued)

OTHER PUBLICATIONS

International Search Report and Written Opinion received in PCT/US2021/056931 mailed Feb. 2, 2022.

*Primary Examiner* — Basil S Katcheves
(74) *Attorney, Agent, or Firm* — Meunier Carlin & Curfman LLC

(57) ABSTRACT

Various implementations include a structure. The structure includes a precast concrete column cap having a first side surface, a second side surface opposite and spaced apart from the first side surface. The structure includes a bottom surface, and a top surface opposite and spaced apart from the bottom surface. The precast concrete column cap includes at least one post-tensioning duct extending between the first side surface and the second side surface. At least one of the first side surface or the second side surface defines a shear key interface. The structure includes at least one precast concrete column having a top surface. The bottom surface of the precast concrete column cap is disposed on the top surface of the at least one column.

16 Claims, 15 Drawing Sheets

(56) References Cited

U.S. PATENT DOCUMENTS

| | | | | |
|---|---|---|---|---|
| 5,161,340 | A * | 11/1992 | Wetton | E04B 1/21 52/236.7 |
| 5,809,712 | A * | 9/1998 | Simanjuntak | E04C 5/08 52/236.8 |
| 10,024,047 | B2 | 7/2018 | Zavitz | |
| 10,094,101 | B1 * | 10/2018 | Jazzar | E04C 3/34 |
| 10,260,224 | B1 * | 4/2019 | Jazzar | E04B 5/04 |
| 10,619,342 | B2 | 4/2020 | Zavitz et al. | |
| 10,822,789 | B1 * | 11/2020 | Mou | E04C 3/36 |
| 10,876,282 | B1 * | 12/2020 | Mou | E04B 1/2608 |
| 10,914,061 | B1 * | 2/2021 | Mou | E04B 1/185 |
| 10,988,920 | B2 | 4/2021 | Zavitz et al. | |
| 11,466,444 | B2 | 10/2022 | Zavitz et al. | |
| 2012/0304564 | A1 * | 12/2012 | Kurczynski | E02D 27/04 52/293.3 |
| 2016/0090728 | A1 | 3/2016 | Miller | |
| 2016/0230386 | A1 * | 8/2016 | Zavitz | E04B 5/43 |
| 2017/0159294 | A1 | 6/2017 | Sanabra Loewe | |
| 2019/0010695 | A1 * | 1/2019 | Zavitz | E04C 3/293 |
| 2019/0376273 | A1 * | 12/2019 | Mou | E04H 9/024 |

* cited by examiner

APPARATUSES AND METHODS FOR CONSTRUCTING A CONCRETE STRUCTURE USING PRECAST CONCRETE COMPONENTS

BACKGROUND

Builders use cast-in-place concrete construction solutions when constructing elevated industrial platforms. The cast-in-place concrete components are formed by pouring concrete into on-site molds to set and solidify. Cast-in-place solutions for creating these monolithic slabs require a builder to dedicate a large amount of the construction time to forming the concrete components. And, these monolithic slabs are subjected to cyclical loads from the operating equipment over the life of the structure, which has a significant effect on the overall integrity of the structure. Pouring concrete for a cast-in-place solution requires time to both pour and cure the concrete and increases the time required for construction of elevated platforms. There exists a need for an elevated platform structure that can be efficiently constructed with reduced wait time and increased resistance to degradation under isotropic load bearing stress.

SUMMARY

Various implementations include a structure that includes a precast concrete column cap and at least one precast concrete column. The precast concrete column cap has a first side surface and a second side surface opposite and spaced apart from the first side surface. The cap has a bottom surface and a top surface opposite and spaced apart from the bottom surface. The precast concrete column cap includes at least one post-tensioning duct extending between the first side surface and the second side surface. At least one of the first side surface or the second side surface defines a shear key interface. The at least one precast concrete column has a top surface. The bottom surface of the precast concrete column cap is disposed on the top surface of the at least one column. In some implementations, the structure has isotropic load-bearing strengths. In some implementations, the at least one precast concrete column includes a first precast concrete column and a second precast concrete column.

In some implementations, the at least one precast concrete column includes a plurality of reinforcement members extending from the top surface of the at least one precast concrete column. The plurality of reinforcement members is coupled to the precast concrete column cap.

In some implementations, the structure further includes a precast concrete floor section having a first side surface and a second side surface opposite and spaced apart from the first side surface. The second side surface of the precast concrete floor section is coupled to the first side surface of the precast concrete column cap.

In some implementations the precast concrete floor section includes at least one post-tensioning duct extending between the first side surface of the precast concrete floor section and the second side surface of the precast concrete floor section. The at least one post-tensioning duct of the precast concrete floor section is aligned with the at least one post-tensioning duct of the precast concrete column cap. The structure further comprises a post-tensioning tendon extending through the at least one post-tensioning duct of the precast concrete column cap and the at least one post-tensioning duct of the precast concrete floor section.

In some implementations, the precast concrete cap includes one of an embedded first assembly or an embedded second assembly. The precast concrete floor section includes the other of the embedded second assembly or the embedded first assembly. The embedded first assembly includes a female tapered threaded portion. The embedded second assembly defines a channel and includes at least one rod disposed within the channel. Each rod has a first portion and a second portion. The second portion of the rod is axially extendable out of the channel of the embedded first assembly. The second portion of the rod defines a male tapered threaded portion. The female tapered threaded portion is configured to receive the male tapered threaded portion of the rod such that the male tapered threaded portion of the rod is threadable into the female tapered threaded portion to couple the rod to the embedded second assembly.

In some implementations, the at least one precast concrete column includes a support bracket. A bottom surface of the precast concrete floor section is disposed on the support bracket.

In some implementations, the structure includes a support beam extending from the at least one precast concrete column. A bottom surface of the precast concrete floor section is disposed on the support beam.

In some implementations, the precast concrete column cap is a first precast concrete column cap. The at least one precast concrete column includes a first precast concrete column and a second precast concrete column. The structure includes a second precast concrete column cap, a third precast concrete column, and a fourth precast concrete column. The second precast concrete column cap is disposed on the top surface of the third precast concrete column and the fourth precast concrete column. The first side surface of the precast concrete floor section is coupled to the second side surface of the second precast concrete column cap.

Various other implementations include a method for making a structure. The method includes: (1) providing at least one precast concrete column having a top surface; and (2) disposing a bottom surface of a precast concrete column cap on the top surface of the at least one precast concrete column, the precast concrete column cap having a first side surface, a second side surface opposite and spaced apart from the first side surface, and a top surface opposite and spaced apart from the bottom surface, the precast concrete column cap including at least one post-tensioning duct extending between the first side surface and the second side surface, wherein at least one of the first side surface or the second side surface defines a shear key interface.

In some implementations the method also includes coupling a precast concrete floor section to the precast concrete column cap. The precast concrete floor section has a first side surface and a second side surface opposite and spaced apart from the first side surface. The second side surface of the precast concrete floor section is coupled to the first side surface of the precast concrete column cap. A precast concrete floor section has a first side surface and a second side surface opposite and spaced apart from the first side surface. The second side surface of the precast concrete floor section is coupled to the first side surface of the precast concrete column cap.

In some implementations, the precast concrete column cap is a first precast concrete column cap and the at least one precast concrete column comprises a first precast concrete column and a second precast concrete column. The method includes providing a third precast concrete column and a fourth precast concrete column, disposing a second precast concrete column cap on the top surface of the third precast concrete column and the fourth precast concrete column, and coupling the first side surface of the precast concrete floor section to the second side surface of the second precast concrete column cap.

BRIEF DESCRIPTION OF THE DRAWINGS

Example features and implementations are disclosed in the accompanying drawings. However, the present disclosure is not limited to the precise arrangements and instrumentalities shown. Similar elements in different implementations are designated using the same reference numerals.

DETAILED DESCRIPTION

Figure 1:
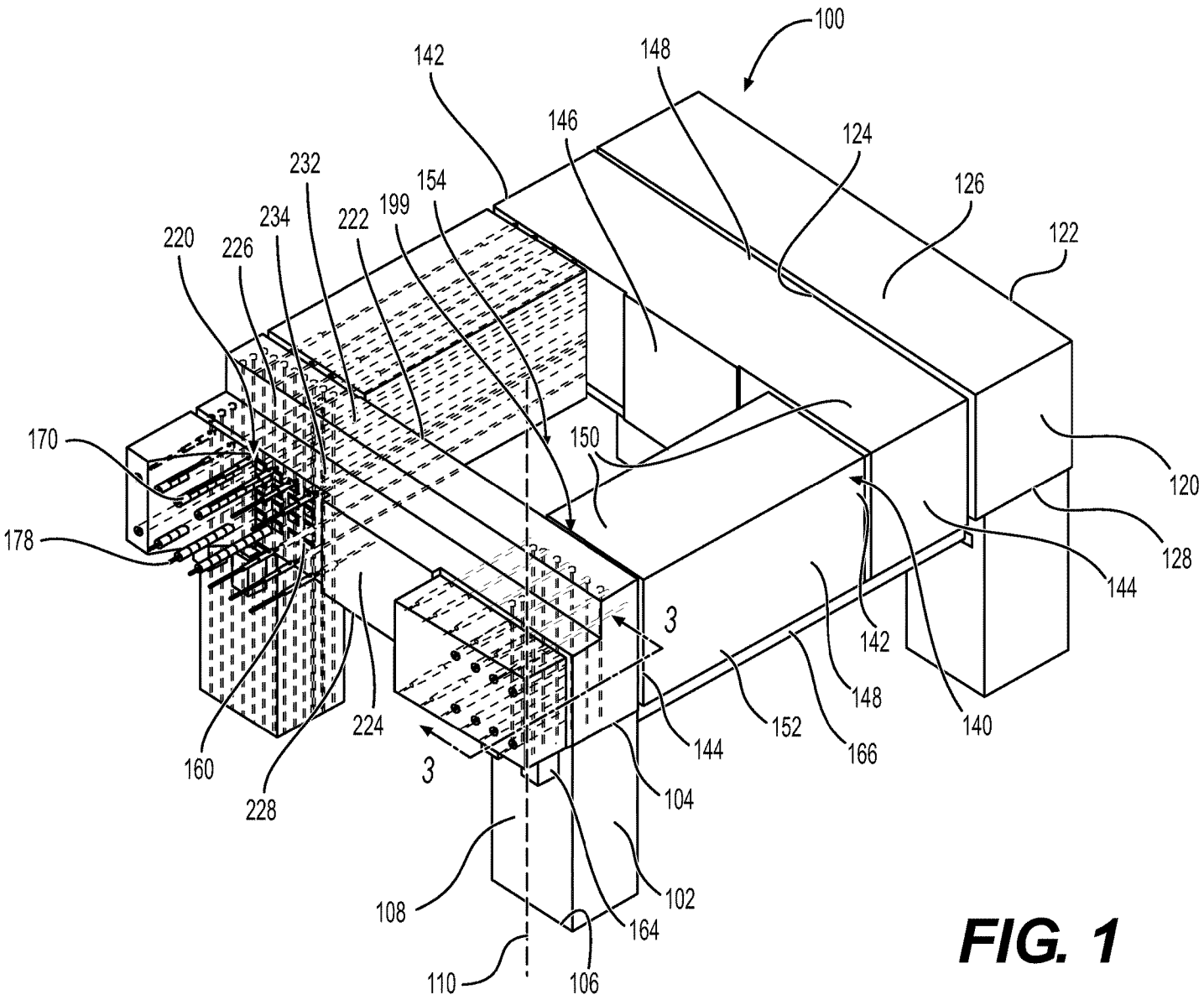
FIG. 1 is a partially cutaway perspective view of a structure according to one implementation.

The devices, systems, and methods disclosed herein include a precast column cap that can be used to secure components of an elevated platform structure and facilitate on-site bonding of the platform structure components. The structure further includes precast columns and precast floor sections that are capable of being assembled without on-site curing time for each component. Construction of the precast concrete members is performed offsite in a controlled environment, significantly reducing the amount of work required in the field. Once on site, the precast concrete members can be assembled and coupled in a fast and efficient manner. Using precast concrete members can reduce overall construction time for a raised industrial platform by eliminating the time dedicated to building molds and pouring and curing concrete.

Various implementations include a structure that includes a precast concrete column cap and a precast column. The precast concrete column cap has a first side surface and a second side surface opposite and spaced apart from the first side surface. The cap also includes a bottom surface and a top surface opposite and spaced apart from the bottom surface. The precast concrete column cap includes at least one post-tensioning duct between the first side surface and the second side surface. At least one of the first side surface or the second side surface defines a shear key interface. The at least one precast concrete column has a top surface. The bottom surface of the precast concrete column cap is disposed on the top surface of the at least one column.

Various implementations also include a method for making a structure. The method includes (1) providing at least one precast concrete column having a top surface and (2) disposing a bottom surface of a precast concrete column cap on the top surface of the at least one precast concrete column. The precast concrete column cap has a first side surface and a second side surface opposite and spaced apart from the first side surface. The precast concrete column cap also has a top surface opposite and spaced apart from the bottom surface. The precast concrete column cap includes at least one post-tensioning duct extending through the column cap between the first side surface and the second side surface. At least one of the first side surface or the second side surface defines a shear key interface.

FIGS. 1-10B show a structure 100 according to one implementation. The structure 100 includes a plurality of precast columns 102, caps 120, 220, and floor sections 140. The structure 100 facilitates efficient construction of platforms by incorporating precast components and long-term bonding materials such as grout. The reinforcing features used to couple the various precast components of the structure 100 allow the structure 100 to withstand supporting elevated platform machinery that exerts reciprocating forces on the structure 100, such as liquid natural gas pumps or other rotating machinery.

FIG. 1 shows a structure 100 with four precast concrete columns 102 that support the caps 120, 220 and the floor sections 140, as discussed below. Each column 102 has a first end 104, a second end 106 opposite and spaced apart from the first end 104, and four side surfaces 108 extending between the first end 104 and the second end 106. A central axis 110 of each column 102 extends between the first and second ends 104, 106. The height of the columns 102, as measured from the first end 104 to the second end 106, is predetermined to locate the top surfaces 150 of the floor sections 140 at a desired elevation. The second ends 106 of each column 102 are disposed partially underground to form a rigid foundation for the structure 100 to carry the weight of the industrial machinery disposed upon it. The first end 104 of the columns 102 directly support the column 102 caps.

Each precast concrete column 102 is a cuboid structure 100, but in other implementations, the column can be cylindrical or polyhedron shaped.

Each column 102 includes a plurality of reinforcement members 112 that extend axially from the first end 104 of each column 102. The reinforcement members 112 provide additional stiffening for the structure 100 between the caps 120, 220 and the supporting columns 102. The reinforcement members 112 are threaded cylindrical steel rods embedded in the columns 102, but in other implementations, the reinforcement members are any other material capable of adding structural support to the columns when embedded in the columns.

Figure 4:
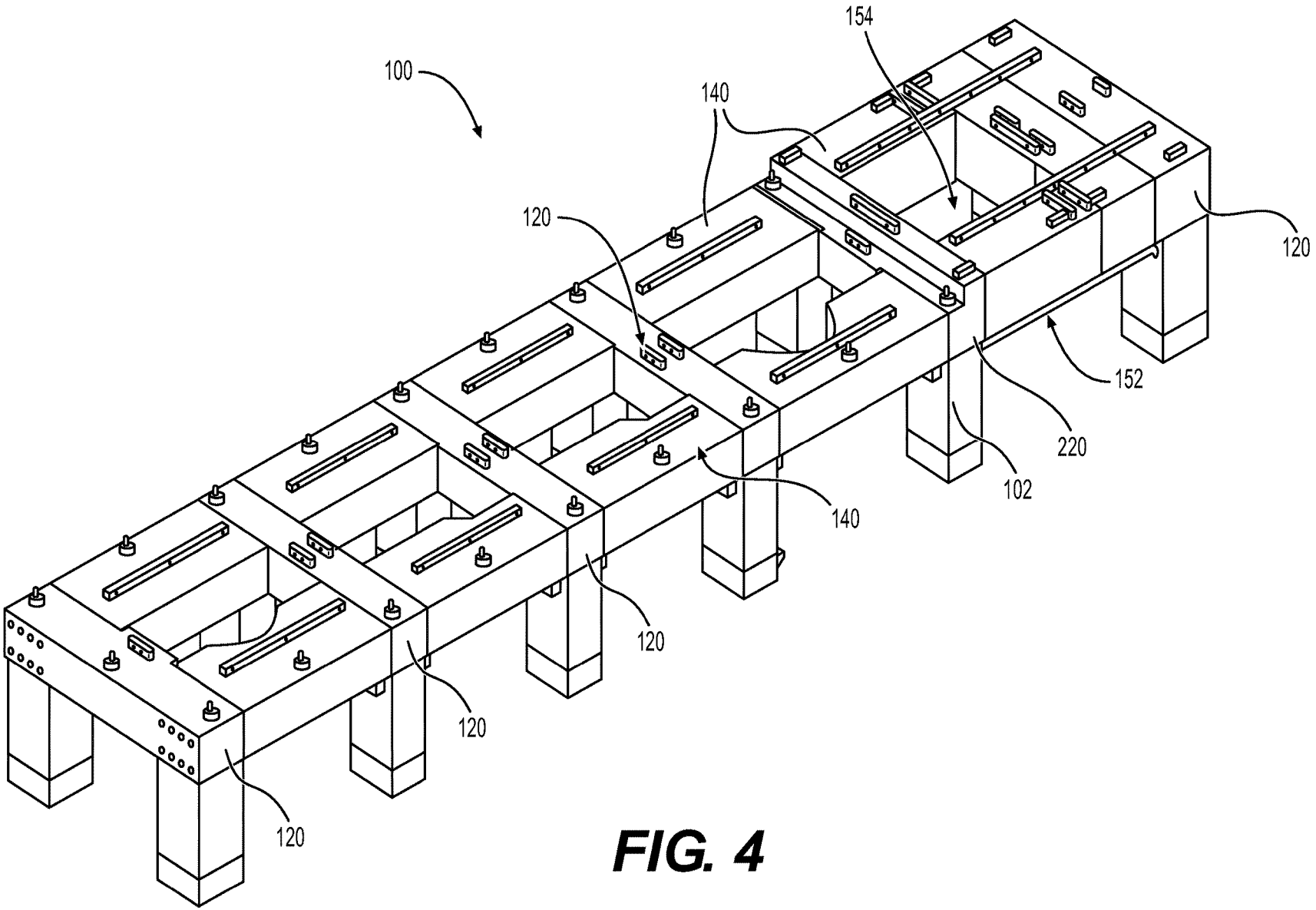
FIG. 4 is a perspective view of the structure according to the implementation shown in FIG. 1.
Figure 5:
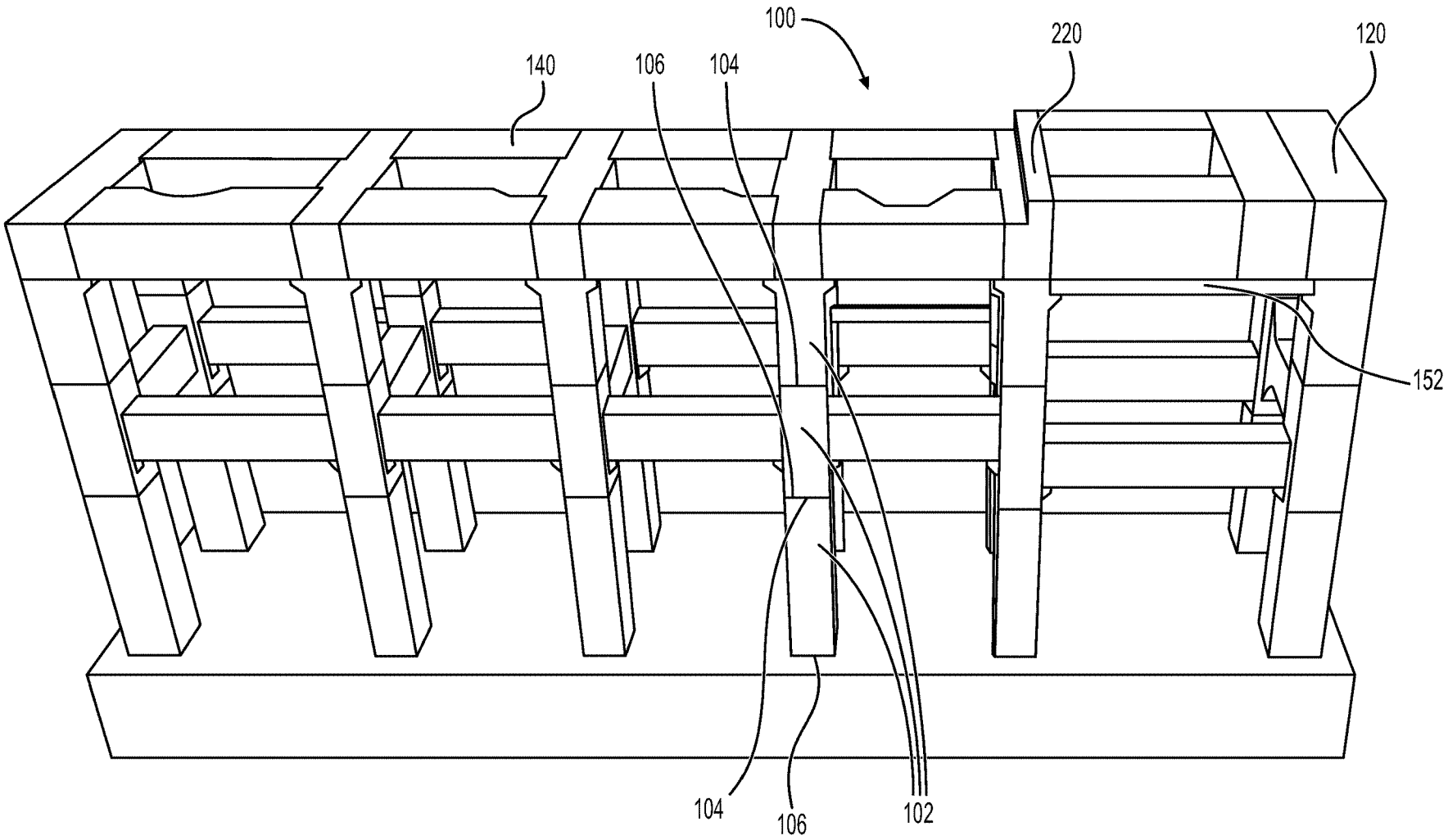
FIG. 5 is a perspective view of a structure according to another implementation.
Figure 6:
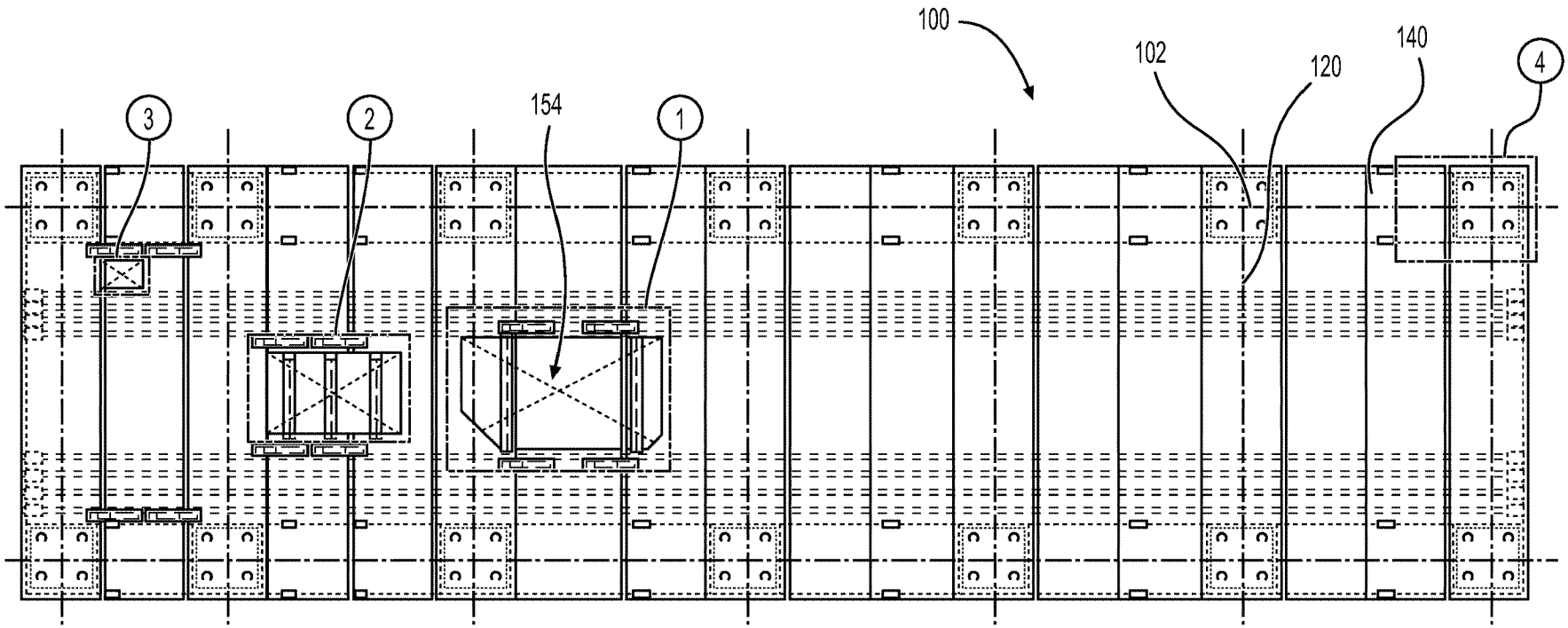
FIG. 6 shows a top schematic view of a structure according to another implementation.
Figure 7:
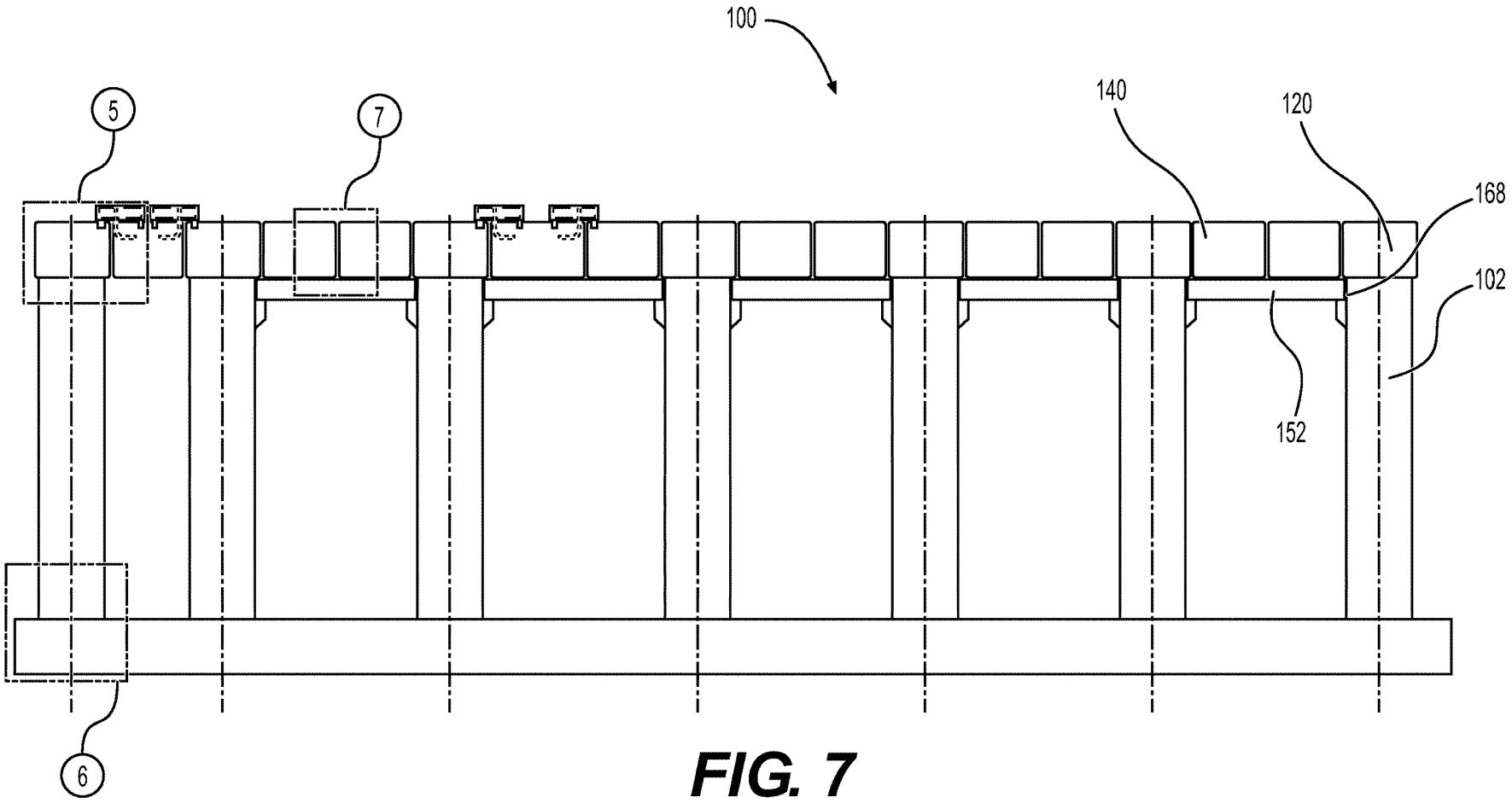
FIG. 7 shows a side schematic view of the structure according to the implementation shown in FIG. 6.
Figure 8A:
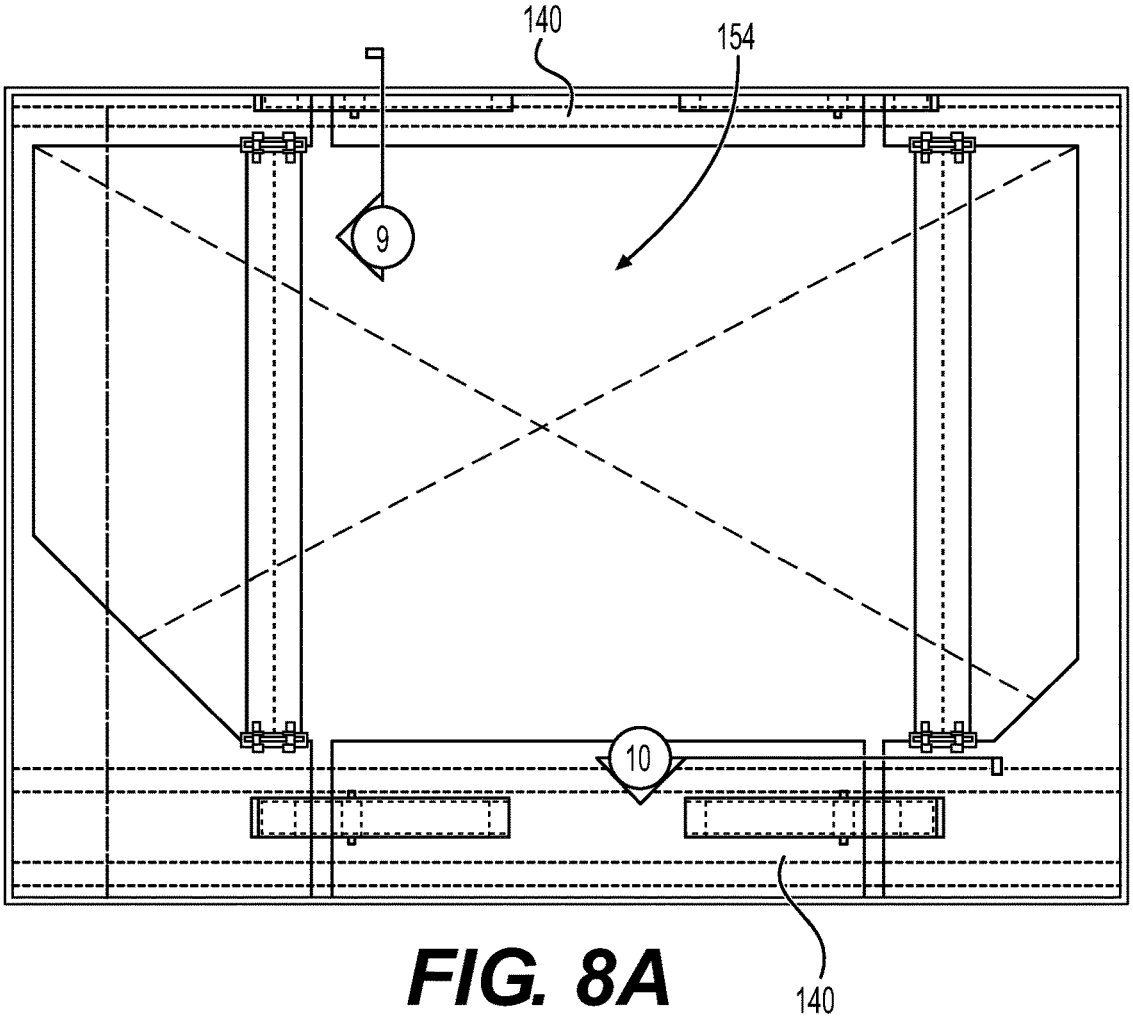
FIG. 8A shows detailed section 1 shown in FIG. 6.
Figure 8B:
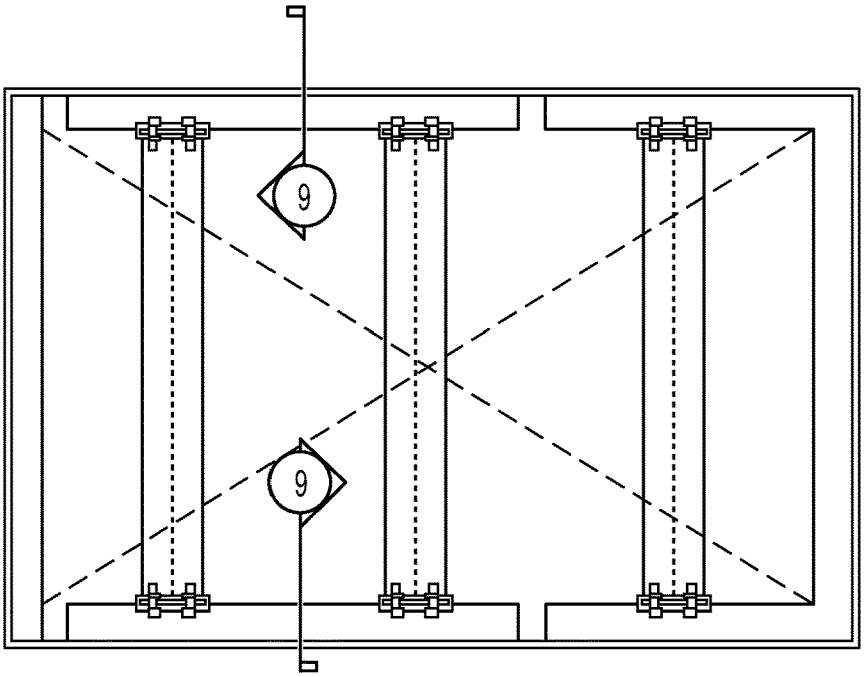
FIG. 8B shows detailed section 2 shown in FIG. 6.
Figure 8C:
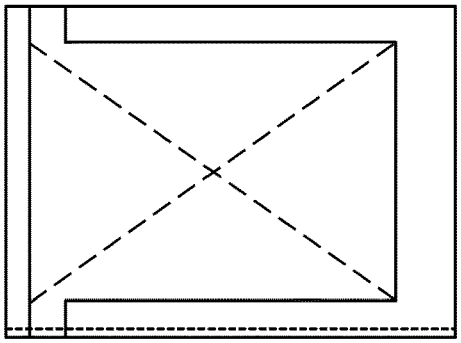
FIG. 8C shows detailed section 3 shown in FIG. 6.
Figure 8D:
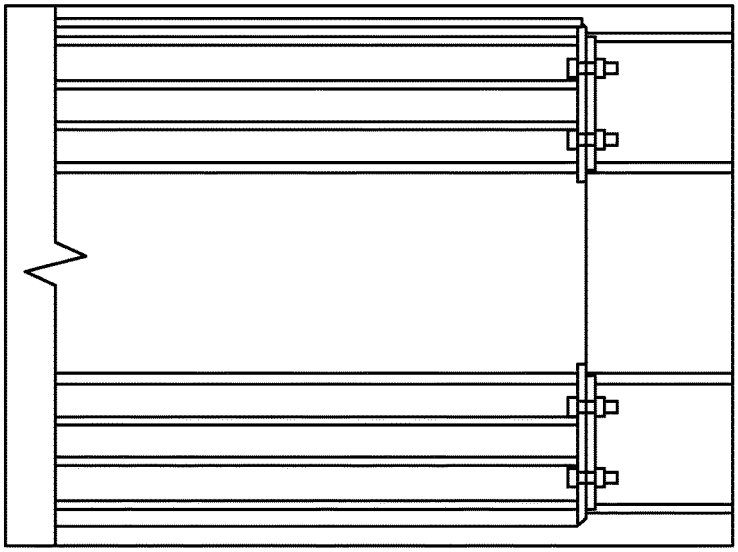
FIG. 8D shows detailed section 9 shown in FIG. 8A.
Figure 8E:
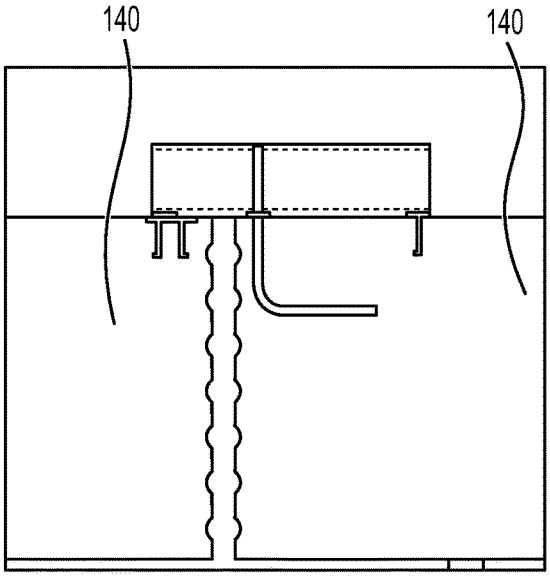
FIG. 8E shows detailed section 10 shown in FIG. 8A.
Figure 9A:
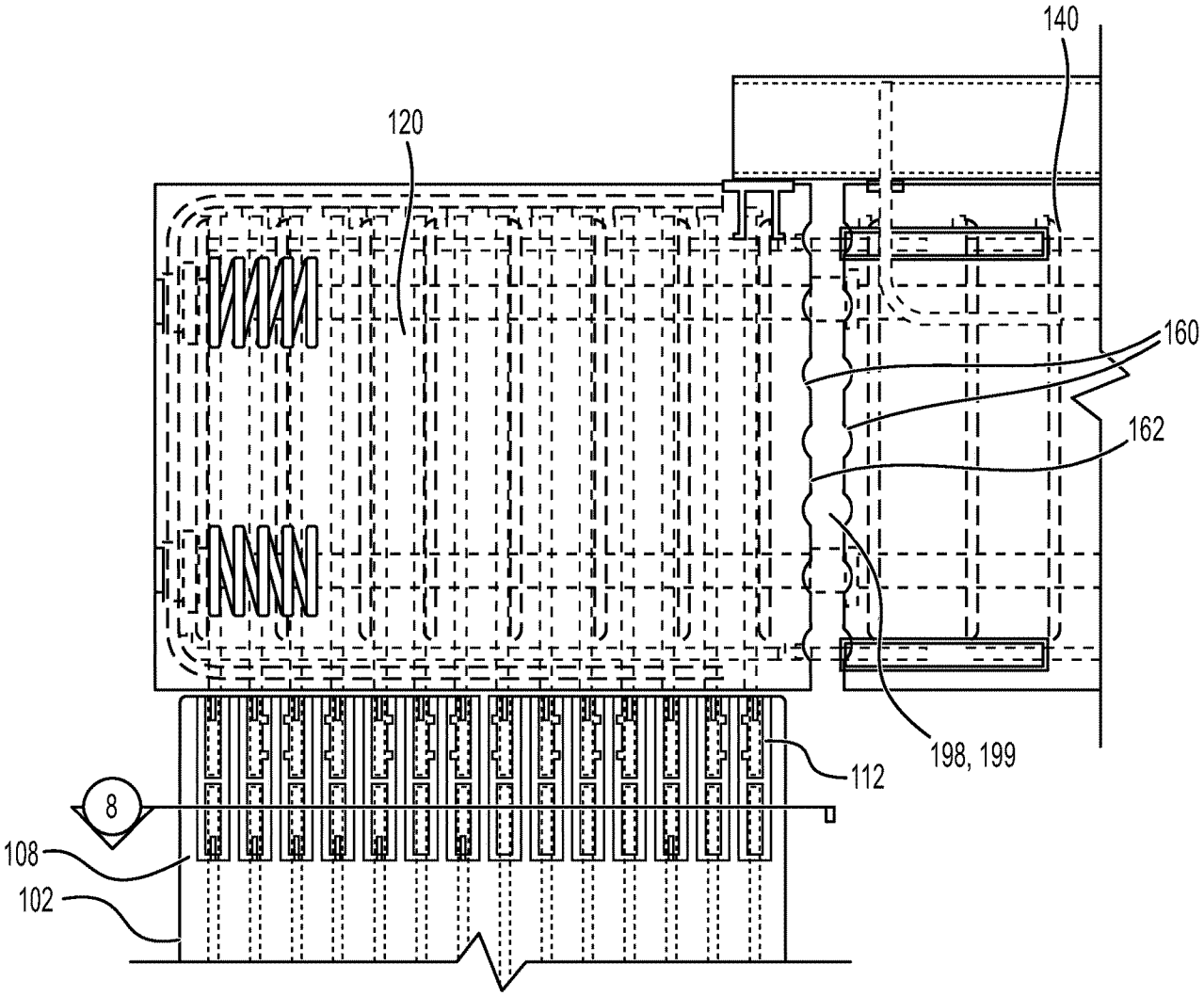
FIG. 9A shows detailed section 5 shown in FIG. 7.
Figure 9B:
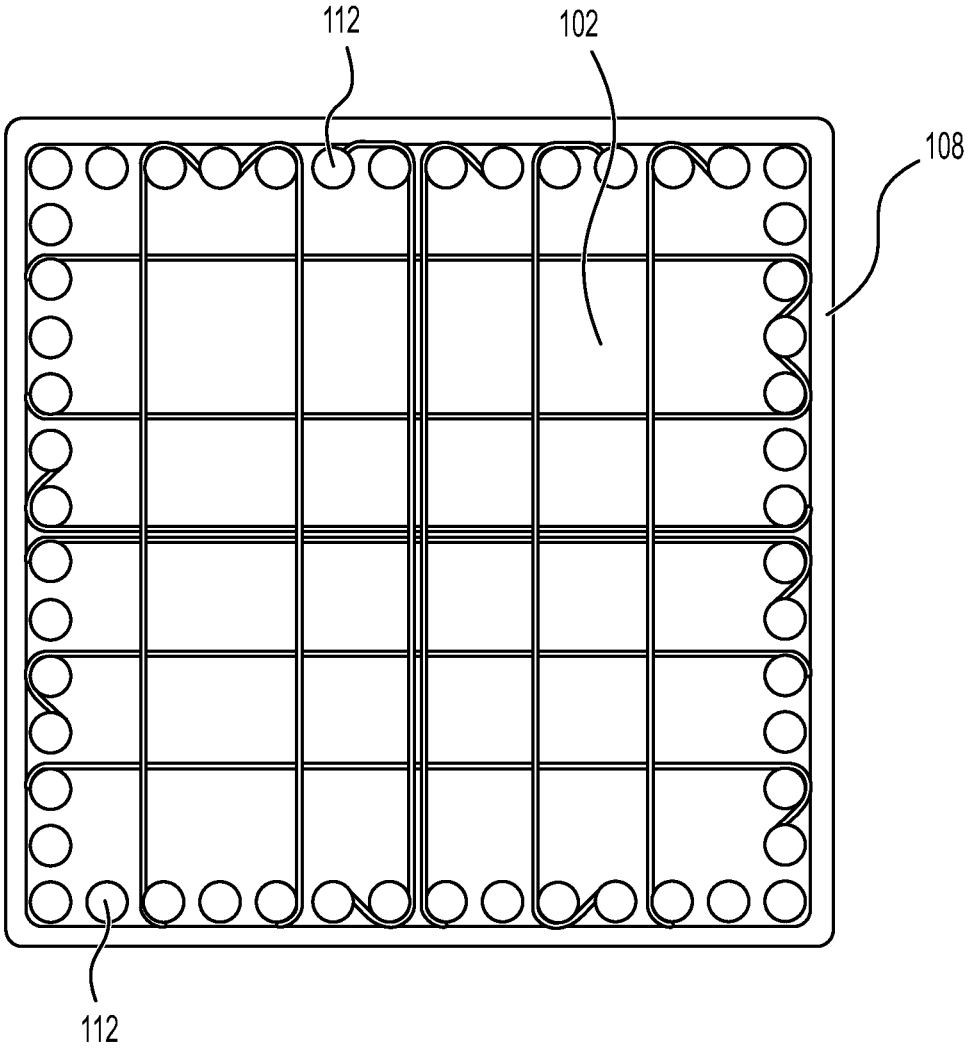
FIG. 9B shows cross section 8 shown in FIG. 9A.
Figure 9C:
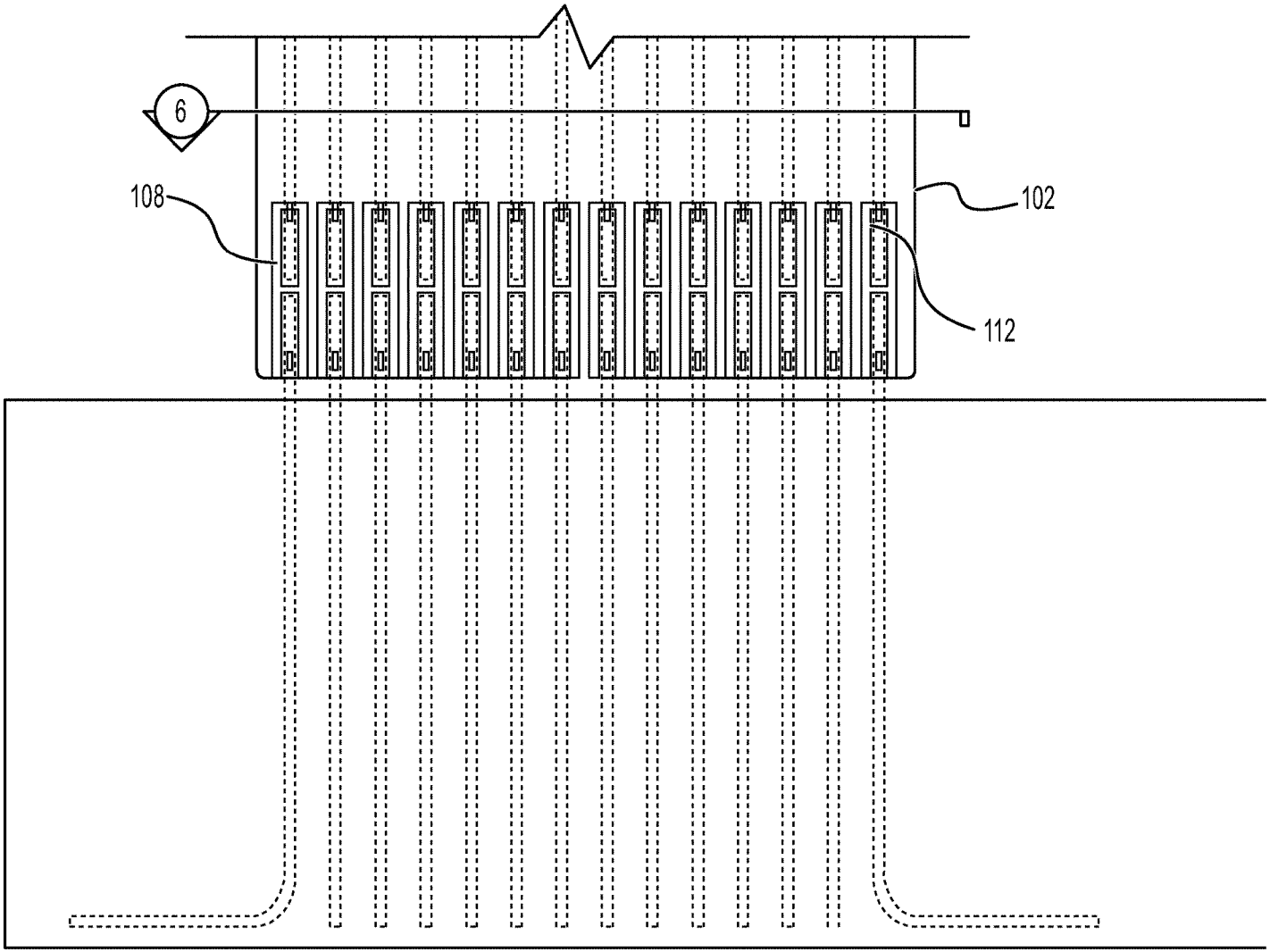
FIG. 9C shows detailed section 6 of FIG. 7.
Figure 9D:
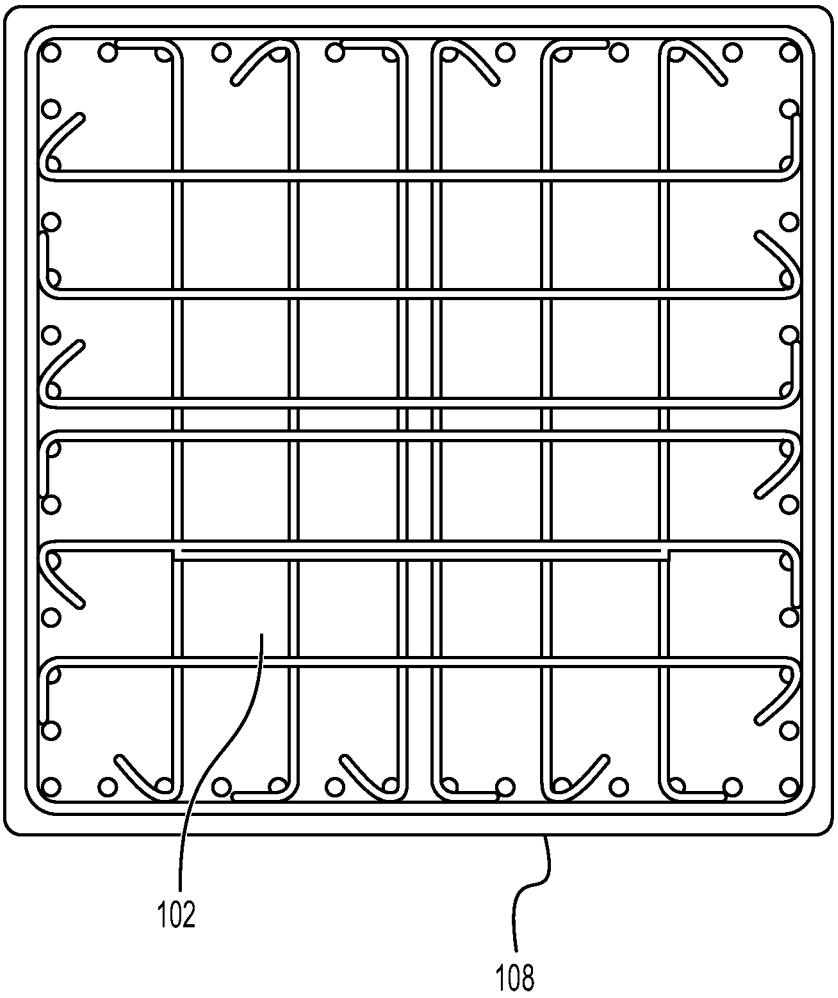
FIG. 9D shows cross section 9 shown in FIG. 9C.

FIG. 1 shows a first precast concrete column cap 120 and a second precast concrete column cap 220. Each of the column caps 120, 220 are disposed on two or more columns 102 and are coupled to one or more floor sections 140. Portions of the cap 120, 220 facilitate distribution of a bonding agent, such as grout 198, during construction. The first precast concrete column cap 120 is shown in FIGS. 1, 4, and 5, and the second concrete column cap 220 is shown in FIGS. 1-5. Each of the caps 120, 220 has a first side surface 122, 222, a second side surface 124, 224 opposite and spaced apart from the first side surface 122, 222, a top surface 126, 226 extending between the first 122, 222 and second side surfaces 124, 224, and a bottom surface 128, 228 opposite and spaced apart from the top surface 126, 226. The bottom surface 128, 228 of each column cap 120, 220 is disposed on, and coupled to, the first ends 104 of two or more columns 102.

The first column cap 120 includes a uniform top surface 126. However, the second column cap 220 has a top surface 226 that includes a first portion 232 and a second portion 234. The first portion 232 and second portion 234 lie in different planes relative to the bottom surface 228 such that the first portion 232 has a first thickness and the second portion 234 has a second thickness that is less than the first thickness 232. The thickness of the first portion 232 corresponds to the thickness of the floor sections 140 coupled to the cap 220 immediately adjacent the first portion 232, and the thickness of the second portion 234 corresponds to the thickness of the floor sections 140 coupled to the cap 220 immediately adjacent the second portion 234, as discussed below. However, in other implementations, the caps can have one or more thicknesses that extend between the top surface and the bottom surface.

As described above, the structure 100 shown in FIG. 1 has four floor sections 140. Each of the floor sections 140 are precast concrete. The floor sections 140 are assembled onsite and, together with the column caps 120, 220, provide a platform on which industrial equipment such as rotating machinery can be disposed and supported. Each floor section 140 includes a first end surface 142, a second end surface 144 opposite and spaced apart from the first end surface 142, a first side surface 146 extending between the first 142 and second end surfaces 144, a second side surface 148 opposite and spaced apart from the first side surface 146, a top surface 150 extending between the first 146 and second side surfaces 148, and a bottom surface 152 opposite and spaced apart from the top surface 150. Each floor section 140 is a rectangular cuboid structure. However, in other implementations, the floor sections can be another three-dimensional shape suitable for supporting an industrial platform.

The floor sections 140 are coupled to the column caps 120, 220 to form a platform. The first 142 and/or second end surfaces 144 of the floor sections 140 can be coupled to a portion of one or more column caps 120, 220. And in some implementations, the first and/or second side surfaces of the floor sections can be coupled to a portion of one or more column caps.

The floor sections 140 can also be assembled with the column caps 120, 220 to define an opening 154 in the center of the platform. For example, the floor sections 140, can be assembled to define an opening 154 through which pipes or other equipment can extend to the machinery disposed on the platform. Alternatively, or in addition thereto, one or more floor sections 140 may define openings 154 therethrough through which pipes or other equipment can extend to the machinery disposed on the platform.

Figure 2:
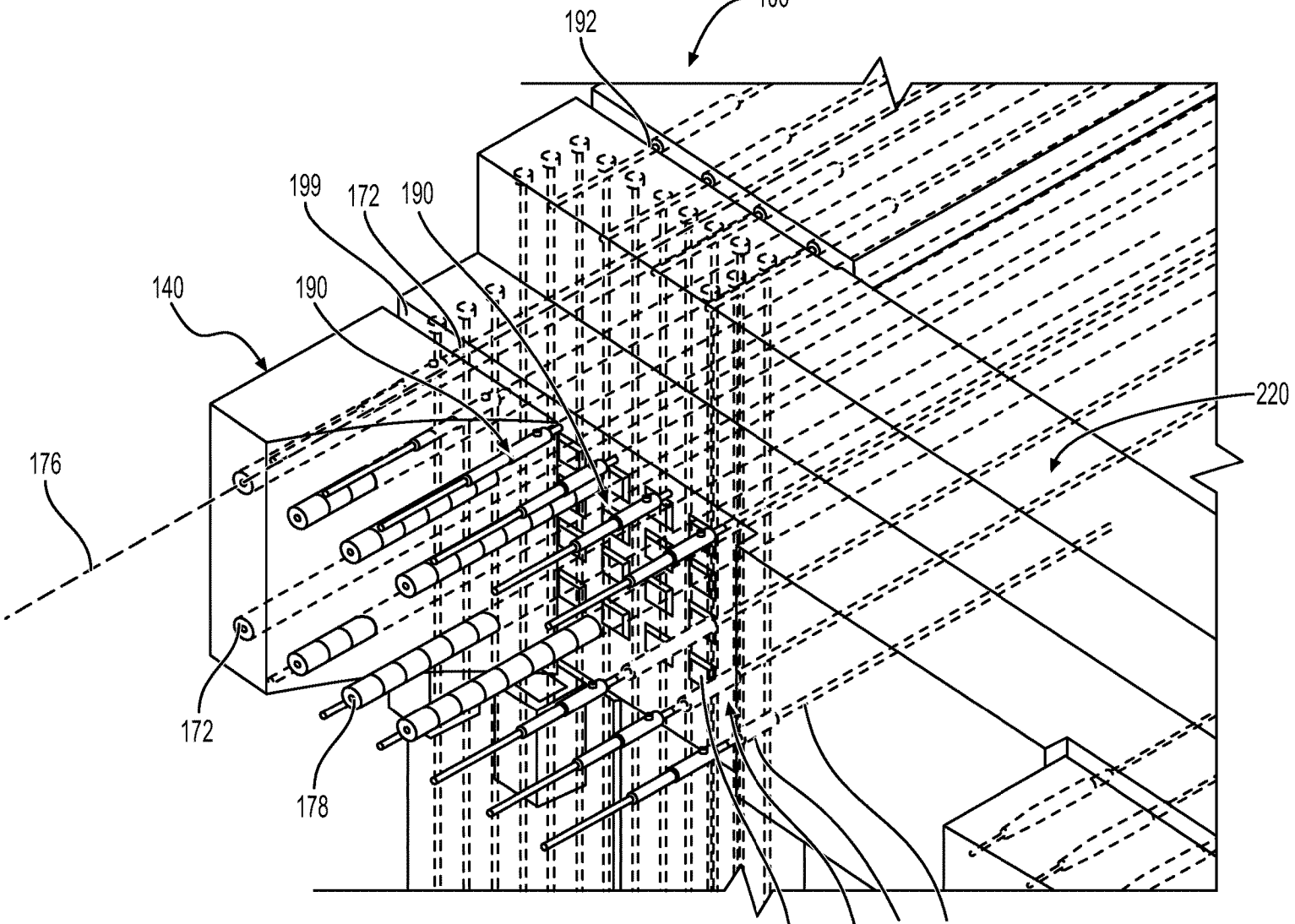
FIG. 2 is a detail view of the cutaway portion of the structure according to the implementation shown in FIG. 1.

FIG. 2 shows a detailed view of the gap 199 defined between a cap 220 and an adjacent floor section 140. A portion of the first side surface 222 of the cap 220 and the first end surface 142 of the floor section 140 each define a shear key interface 160. The shear key interfaces 160 each include a plurality of protrusions 162 that provide a textured surface. For example, the protrusions 162 in FIG. 2 are arranged in an array having four rows and six columns. The protrusions 162 increase resistance to fracture and shear deformation between the cap 120, 220 and the adjacent floor section 140 when the first side surface 122, 222 of the cap 120, 220 and the first end surface 142 of the floor section 140 are coupled to each other by grout 198, as shown in FIGS. 1-5. The shear key interfaces 160 further increase rigidity of the structure 100 when grout 199 settles in the gap 199 between the cap 120, 220 and adjacent floor sections 140. Although the shear key interfaces 160 shown in FIG. 2 include protrusions 162 arranged in an array having at least two rows and at least two columns, in other implementations, one or more shear key interfaces define indentions or a combination of protrusions and indentions. The protrusions and/or indentations may be arranged in an array having at least one row and at least one column or may be arranged randomly. Although the shear key interfaces 160 shown in FIG. 2 are defined by a portion of the first side surface 222 of the cap 220 and the first end 142 of the floor section 140, in some implementations, the shear key interfaces can defined on any adjacent surfaces of caps and floor sections that define a gap in which grout can be used to couple together the caps and floor sections.

FIG. 2 also shows a series of post tensioning ducts 170 extending through the cap 220 and the floor section 140. The post tensioning ducts 170 are cylindrically shaped tubes with an inner diameter sized to accept a post tensioning tendon 178, as described below. A first set of post tensioning ducts 170 extends between the second side surface 224 of the cap 220 and the first side surface 222 of the cap 220, and a second set of post tensioning ducts 170 extends between the first end surface 142 of the floor section 140 and the second end 144 surface of the floor section 140. A central axis 176 extends between the ends of each post tensioning duct 170. Each of the first and second sets of post tensioning ducts 170 shown in FIG. 2 includes eight post-tensioning ducts 170 arranged in two rows of four equally spaced post-tensioning ducts 170. In some implementations of the floor sections 140, such as floor section 140 shown in FIG. 1 in which the floor section 140 is disposed horizontally adjacent the cap 120 to define a gap 199 between the first side surface 146 of the floor section 140 and the first side surface 122 of the cap 120, the second set of post tensioning ducts 170 extends between the first side surface 146 of the floor section 140 and the second side surface 148 of the floor section 140.

Although the first set of post tensioning ducts 170 and the second set of post tensioning ducts 170 each include eight post tensioning ducts 170, in other implementations, the first set of post tensioning ducts and the second set of post tensioning ducts each include any number of post tensioning ducts suitable for increasing the strength of the platform. The post tensioning ducts 170 of the first set of post tensioning ducts 170 and the second set of post tensioning ducts 170 can also be disposed in any arrangement suitable for increasing resistance to isotropic loading when a post tensioning tendon 178 (e.g., steel cable) is inserted therethrough such that the post tensioning ducts 170 of the first set of post tensioning ducts 170 axially align with the post tensioning ducts 170 of the second set of post tensioning ducts 170 when the floor section 140 is positioned adjacent to the cap 120, 220.

Figure 3:
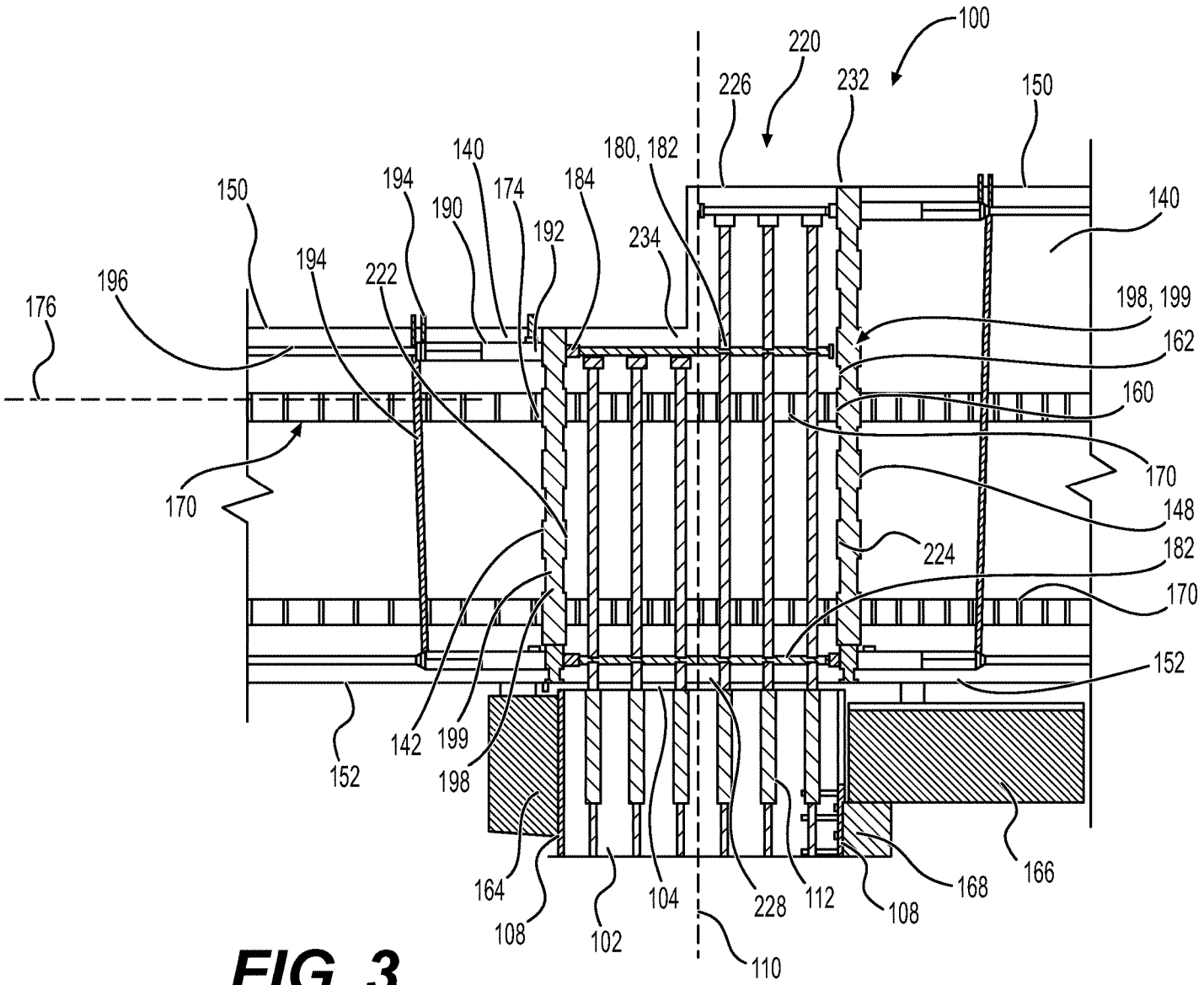
FIG. 3 is a section view of the structure shown in FIG. 1 taken along line 3-3.

Although the post-tensioning ducts 170 shown in FIGS. 1-3 are cylindrically shaped tubes, in other implementations, the post-tensioning ducts can be any elongated three-dimensional shaped tubes.

When the floor section 140 is disposed adjacent the cap 120, 220 in a position to be coupled to the cap 120, 220, each of the post tensioning ducts 170 in the cap 120,220 axially aligns with a respective post tensioning duct 170 in the floor section 140. A post-tensioning tendon 178 is inserted through one or more of the axially aligned post tensioning ducts 170 such that the post tensioning tendons 178 extend through the post-tensioning ducts 170 in an axial direction.

The post tensioning tendons 178 can be axially tensioned to compress the concrete in the cap 120, 220 and the floor section 140 to prestress the cap 120, 220 and floor section 140, structurally integrating the floor sections 140 with the cap 120, 220. The flexible structure of the un-stretched tendons 178 allows for ease of installation within the post tensioning ducts 170, while the tendons 178 can be tensioned within the post tensioning ducts 170 to compress the pre-cast concrete components, increasing the isotropic load bearing strength of the structure 100. Inclusion and placement of the post tensioning tendons 178 throughout the structure 100 during construction increases axial, shear, bending, and torsional rigidity for long term loading, without requiring concrete to be poured and set around steel structures onsite. The post tensioning tendons 178 can extend through any number of axially aligned post tensioning ducts 170 embedded in concrete elements to compress the concrete elements together.

The cap 220 shown in FIG. 2 includes an embedded first assembly 180. In the embodiment shown in FIG. 2, the cap 220 includes twelve first assemblies 180. Six of the embedded first assemblies 180 are arranged in a row through an upper portion of the cap 220, and an additional six embedded first assemblies 180 are arranged in a row through a lower portion of the cap 220.

Each embedded first assembly 180 includes a female tapered threaded portion 184 and reinforcement member 182. Although FIG. 2 shows the female tapered threaded portion 184 as a threaded nut, in other implementations, the female tapered threaded portion can be any threaded portion for receiving a male tapered threaded portion of the rod of the embedded second assembly, as described below. One end of the female tapered threaded portion 184 is open to the first side surface 222 of the cap 220. The reinforcement member 182 may be permanently threaded into the opposite end of the female tapered threaded portion 184 and can extend to another female tapered threaded portion 184 on an opposite side of the cap 220.

The embedded second assembly 190 defines a channel 192 through a portion of the floor section 140 that is open to the first end surface 142 of the floor section 140. A threaded rod 191 of each embedded second assembly 190 is initially contained at least partially within the channel 192 of the embedded second assembly 190 but is rotatable to extend a portion of the rod 191 having a male tapered threaded portion out of the channel 192 of the embedded second assembly 190 and out of the first side surface 142 of the floor section 140. During assembly, the threaded rod 191 is rotated until the portion of the threaded rod 191 having a male tapered threaded portion extends into the female tapered threaded portion 184 of the embedded first assembly 180 in the cap 220. A reinforcement member 196 is disposed in an opposite end of the channel 192 of the embedded second assembly 190 and extends the length of the floor section 140. The opposite end of the reinforcement member 196 may extend into a channel 192 of another embedded second assembly 190 or a female tapered threaded portion 184 in another embedded first assembly 180 on the opposite end of the floor section 140. The embedded second assembly 190 also includes at least one grout port 194 in fluid communication with the channel 192 of the embedded second assembly 190. The grout port 194 can receive grout 198 into the channel 192 of the embedded second assembly 190 after the threaded rod 191 is turned to extend into the embedded first assembly 180 such that the grout 198 will surround the threaded rod 191 and prevent the threaded rod 191 from rotating and uncoupling from the female tapered threaded portion 184 of the embedded first assembly 180. The grout 198 within the channel 192 also surrounds the reinforcement member 196 to couple the reinforcement member 196 to the channel 192. Although the rod 191 shown in FIG. 2 is a threaded rod, in other implementations, the rod is unthreaded, and the rod is extendable from the channel by applying an axial force to the rod.

The first and second assemblies 180, 190 are axially aligned when the cap 220 is disposed adjacent the floor section 140, and the male tapered threaded portion of the threaded rod 191 of each embedded second assembly 190 can be extended into the female tapered threaded portion 184 of the respective embedded first assembly 180 of the cap 220 adjacent to the floor section 140. In this manner, the threaded rods 191 of the floor section 140 can connect to the reinforcement members 182 extending through the cap 220.

Although FIG. 2 shows the embedded first assemblies 180 disposed within the cap 220 and the embedded second assemblies 190 disposed within the floor section 140, in other implementations, the embedded first assemblies are disposed within the floor section and the embedded second assemblies are disposed within the cap. In another alternative arrangement, the cap includes one or more first assemblies and one or more second assemblies that align with one or more second assemblies and one or more first assemblies, respectively, in the floor section. In some implementations, the cap and floor section include any number of embedded first assemblies and embedded second assemblies located in any arrangement.

In other implementations, the embedded first assembly includes the threaded rod, and the threaded rod is rotatable to extend from the embedded first assembly into a portion of the channel of the embedded second assembly. The grout pumped into the grout port(s) of the embedded second assembly surrounds the portion of the threaded rod disposed within the channel such that the grout coupled the threaded rod of the embedded first assembly to the embedded second assembly without the threaded rod directly engaging a surface of the channel.

A support bracket 164 is coupled to one or more side surfaces 108 of the columns 102 to support a floor section 140 during assembly. The support brackets 164 each have a support surface that supports an adjacent floor section 140 as shown in FIG. 3. In some implementations, the support brackets are coupled to the columns by bolts, screws, rivets, adhesive, or any other method suitable to securely couple a support bracket 164 to a concrete column 102. In some implementations, the support brackets are reinforced concrete that is cast with the column.

In some implementations, such as shown in FIGS. 1-9 and 10A-10B, each column 102 includes a protrusion 168 that extends from a side surface 108 of two or more columns 102. The protrusion 168 supports a support beam 166 for supporting the bottom surface 166 of floor sections 140 before they are permanently coupled to adjacent floor sections 140 and caps 120, 220. The support beams 166 can be removed from the structure 100 after the floor sections 140 are permanently coupled. Each of the support beams 166 is a steel I-beam. However, in other implementations, the beams may be T-beams or rectangular beams.

To assemble the structure 100, a column cap 220 is coupled to the first ends 104 of at least two columns 102. A protrusion 168 is coupled to a side surface 108 of each of four columns 102 and a two support beams 166 are supported by the support beams 164 such that the support beams 168 extend between pairs of columns 102 In the implementation shown in FIG. 2, the floor section 140 is disposed horizontally adjacent the cap 220 to define a gap 199 between the first end surface 142 of the floor section 140 and the first side surface 222 of the cap 220. For some implementations of the floor sections 140, such as the floor section 140 shown in FIG. 1, the floor section 140 is disposed horizontally adjacent the cap 120 to define a gap 199 between the first side surface 146 of the floor section 140 and the first side surface 122 of the cap 120.

Figure 10A:
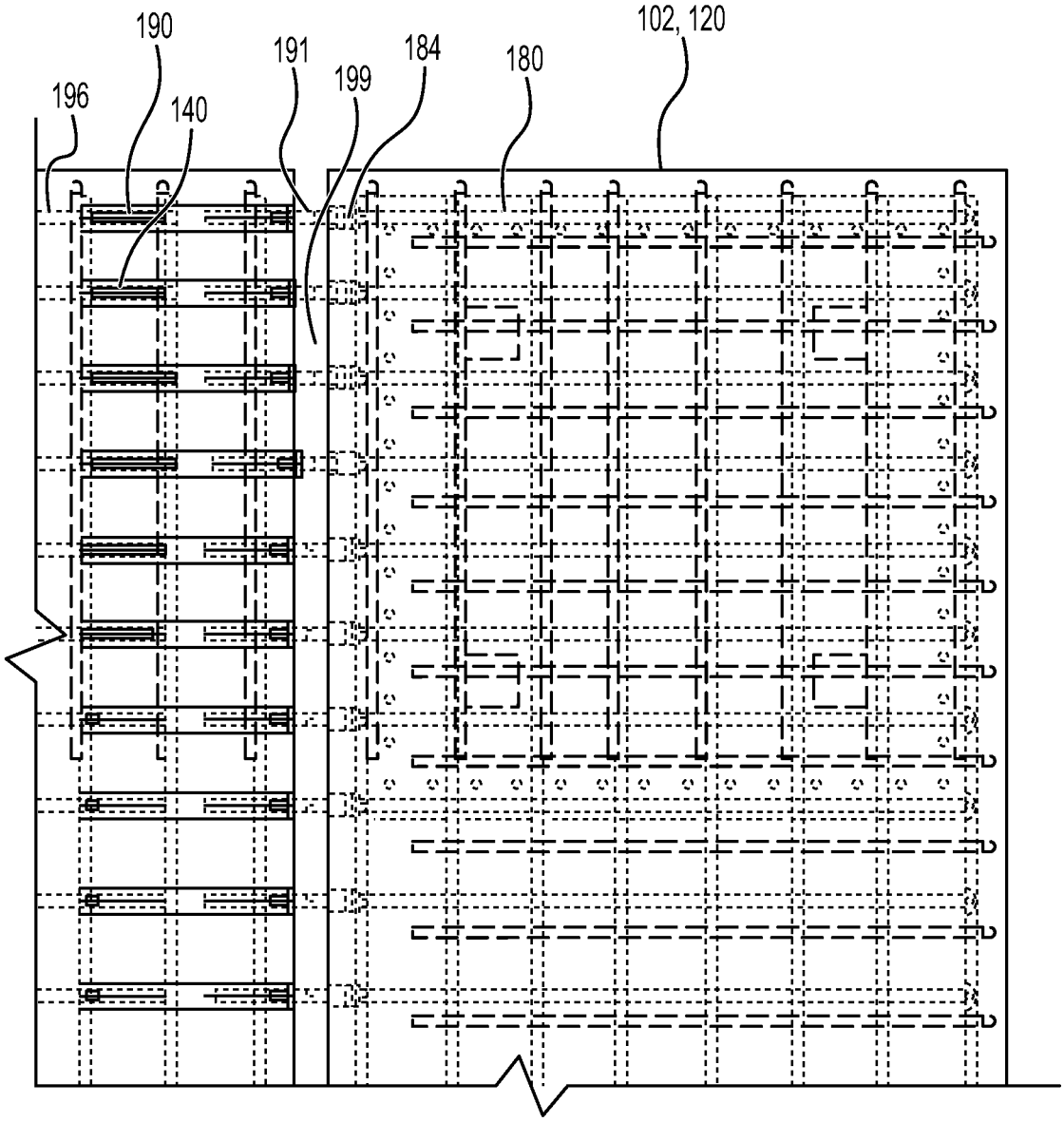
FIG. 10A shows detailed section 4 shown in FIG. 6.
Figure 10B:
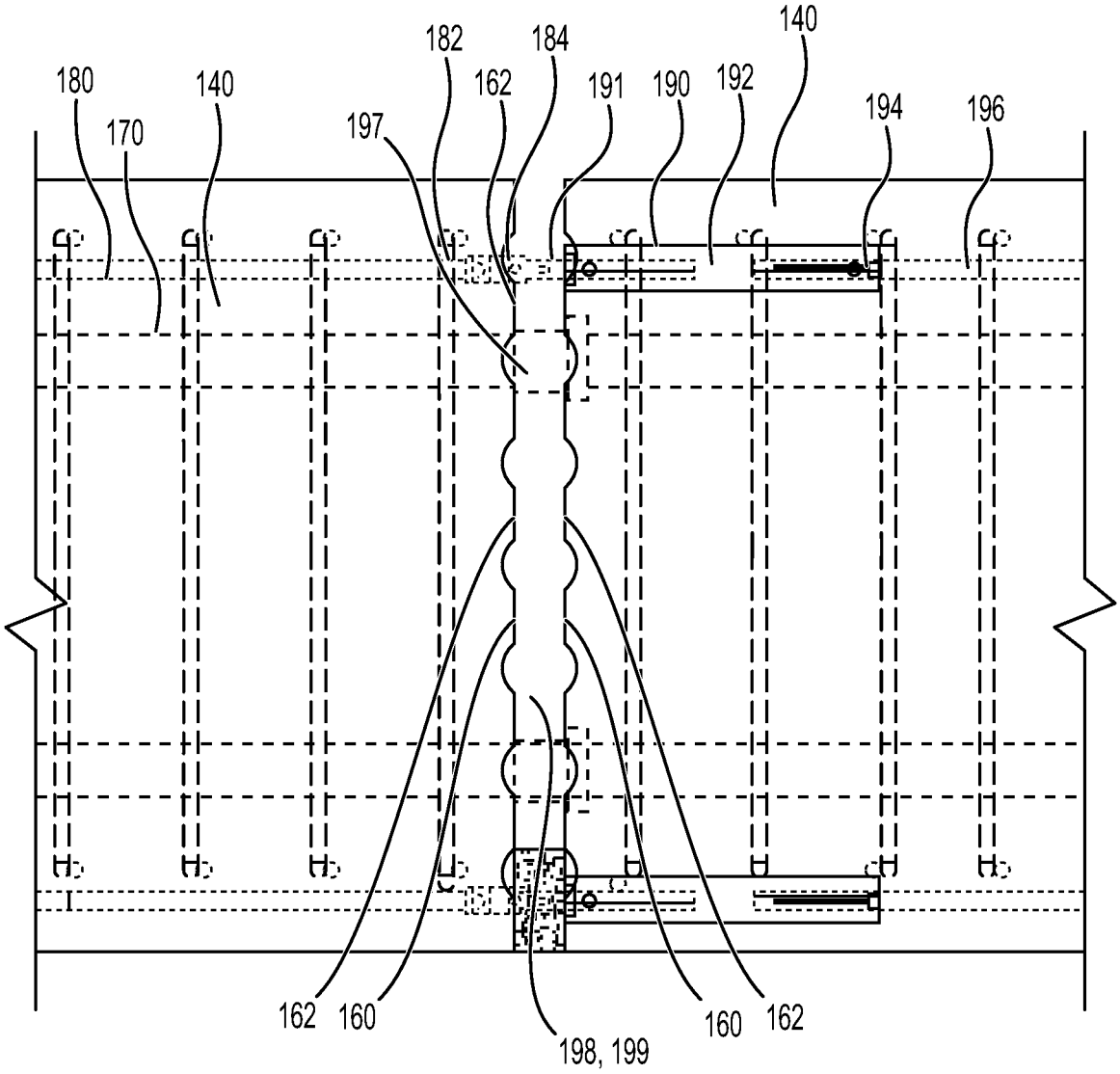
FIG. 10B shows detailed section 7 of FIG. 7.

As shown in FIG. 10B, a duct coupler 197 is disposed within the gap 199 to extend between the post tensioning ducts 170 to prevent grout 198 from entering the post tensioning ducts 170 during grouting. The threaded rods 191 of each of the embedded second assemblies 190 are rotated to extend the male tapered threaded portion of the threaded rod 191 into the female tapered threaded portion 184 of the embedded first assemblies 180. A frame is then assembled around the gap 199 between the cap 220 and the floor section 140. Grout 198 is then fed into grout ports 194 of each of the embedded second assemblies 190 of the bottom row of embedded second assemblies 190 to fill the empty volume in the channels 192 in these embedded second assemblies 190. The excess grout 198 flows out of the channels 192 in the embedded second assemblies 190 such that the grout 198 fills the gap 199 between the cap 220 and the floor section 140 to just above the openings of the channels 192 of the bottom row of embedded second assemblies 190. The top row of embedded second assemblies 190 are sealed at the gap 199 to prevent grout 198 from the gap 199 from entering the channels 192. Each of embedded second assemblies 190 in the top row are then pumped with grout 198 independently.

Next, the remaining gap 199 is filled by pouring the grout directly into the gap 199. A less expensive grout 198 can be used to fill the relatively larger volume of the gap 199. The grout 199 engages with the shear key interfaces 160 defined by the first side surface 222 of the cap 220 and the first end surface 142 of the floor section 140. The grout 198 is contained by the frame until it cures.

Post tensioning tendons 178 are extended through each of the axially aligned post tensioning ducts 170. After the grout 198 within the gap 199 has cured to a minimum strength, the post tensioning tendons 178 are stressed and the post tensioning ducts 170 are pumped with grout 198 throughout their full length. Once all of the grout 198 has cured, the coupling of the cap 220 and floor section 140 is complete.

In some implementations, a cap and floor section can be coupled to each other by filling the entire gap with grout pumped through one or more grout ports of the embedded second assemblies without pouring any grout directly into the gap. In some implementations, the grout is poured directly into the gap, and suction is applied to the grout ports to cause the grout to flow from the gap, through the channels of the embedded second assemblies, and into the grout ports. In some implementations, the grout is disposed directly into the gap and the grout is allowed to passively flow into the channels of the embedded second assemblies.

For the implementation shown in FIGS. 1-5 the bottom surfaces 128, 228 of the caps 120, 220 are disposed on the first end 104 of the first column 102 and the first end 104 of the second column 102, respectively.

The bottom surfaces of two support beams 166 are each placed on a respective protrusion 168 of the columns 102. The lengths of each of the support beams 166 are perpendicular to the lengths of first column 102 and the second column 102. The first floor section 140 and the second floor section 140 are each placed on the top surfaces of the respective support beams 166, such that the length of each support beam 166 is aligned with the length of each respective floor section 140.

The structure 100 can be coupled to other structures 100 of the same or similar shape to form a plurality of platforms. In some implementations (not shown), a second cap is coupled to an additional set of columns, similar to the cap described above. A second side surface of the second cap is coupled to a first side surface of an adjacent floor section and the second side surface of the adjacent floor section is coupled to the first side surface of the cap to form a series of platforms. The platforms are further coupled together horizontally by passing post tensioning tendons through adjacent post tensioning ducts in each floor section in structures such as those shown in FIGS. 4-5. The platforms are coupled together vertically by coupling the first ends of columns to the second ends of columns, as shown in FIG. 5.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

The invention claimed is:

1. A structure comprising:

a precast concrete column cap having a first side surface, a second side surface opposite and spaced apart from the first side surface, a bottom surface, and a top surface opposite and spaced apart from the bottom surface, wherein at least one of the first side surface or the second side surface defines a shear key interface;

at least one precast concrete column having a top surface, wherein the bottom surface of the precast concrete column cap is disposed on the top surface of the at least one precast concrete column; and a precast concrete floor section having a first side surface and a second side surface opposite and spaced apart from the first side surface, the second side surface of the precast concrete floor section being coupled to the first side surface of the precast concrete column cap, wherein the precast concrete column cap further comprises one of an embedded first assembly or an embedded second assembly, and the precast concrete floor section further comprises an other of the embedded second assembly or the embedded first assembly, wherein the embedded first assembly includes a female tapered threaded portion, wherein the embedded second assembly defines a channel and includes at least one rod disposed within the channel, each rod having a first portion and a second portion, wherein the second portion of the rod is axially extendable out of the channel of the embedded second assembly, wherein the second portion of the rod defines a male tapered threaded portion, and wherein the female tapered threaded portion is configured to receive the male tapered threaded portion of the rod such that the male tapered threaded portion of the rod is threadable into the female tapered threaded portion to couple the rod to the embedded first assembly.

2. The structure according to claim 1, wherein the structure has isotropic load- bearing strengths.

3. The structure according to claim 1, wherein the at least one precast concrete column comprises a first precast concrete column and a second precast concrete column.

4. The structure according to claim 1, wherein the at least one precast concrete column comprises a plurality of reinforcement members extending from the top surface of the at least one precast concrete column, and the plurality of reinforcement members are coupled to the precast concrete column cap.

5. The structure according to claim 1, wherein the precast concrete column cap includes at least one post-tensioning duct extending between the first side surface and the second side surface, wherein the precast concrete floor section includes at least one post-tensioning duct extending between the first side surface of the precast concrete floor section and the second side surface of the precast concrete floor section, the at least one post-tensioning duct of the precast concrete floor section being aligned with the at least one post-tensioning duct of the precast concrete column cap, and the structure further comprises a post-tensioning tendon extending through the at least one post-tensioning duct of the precast concrete column cap and the at least one post-tensioning duct of the precast concrete floor section.

6. The structure according to claim 1, wherein the at least one precast concrete column includes a support bracket, and a bottom surface of the precast concrete floor section is disposed on the support bracket.

7. The structure according to claim 1, further comprising a support beam extending from the at least one precast concrete column, and a bottom surface of the precast concrete floor section is disposed on the support beam.

8. The structure according to claim 1, wherein the precast concrete column cap is a first precast concrete column cap and the at least one precast concrete column comprises a first precast concrete column and a second precast concrete column, and the structure further comprises a second precast concrete column cap, a third precast concrete column, and a fourth precast concrete column, wherein the second precast concrete column cap is disposed on the top surface of the third precast concrete column and the fourth precast concrete column, the first side surface of the precast concrete floor section being coupled to the second side surface of the second precast concrete column cap.

9. A method for making a structure comprising:

providing at least one precast concrete column having a top surface;

disposing a bottom surface of a precast concrete column cap on the top surface of the at least one precast concrete column, the precast concrete column cap having a first side surface, a second side surface opposite and spaced apart from the first side surface, and a top surface opposite and spaced apart from the bottom surface, wherein at least one of the first side surface or the second side surface defines a shear key interface; and coupling a precast concrete floor section to the precast concrete column cap, the precast concrete floor section having a first side surface and a second side surface opposite and spaced apart from the first side surface, the second side surface of the precast concrete floor section being coupled to the first side surface of the precast concrete column cap, wherein the precast concrete column cap further comprises one of an embedded first assembly or an embedded second assembly, and the precast concrete floor section further comprises an other of the embedded second assembly or the embedded first assembly, wherein the embedded first assembly includes a female tapered threaded portion, wherein the embedded second assembly defines a channel and includes at least one rod disposed within the channel, each rod having a first portion and a second portion, wherein the second portion of the rod is axially extendable out of the channel of the embedded second assembly, wherein the second portion of the rod defines a male tapered threaded portion, and wherein the female tapered threaded portion is configured to receive the male tapered threaded portion of the rod such that the male tapered threaded portion of the rod is threadable into the female tapered threaded portion to couple the rod to the embedded first assembly.

10. The method according to claim 9, wherein the structure has isotropic load-bearing strengths.

11. The method according to claim 9, wherein the at least one precast concrete column comprises a first precast concrete column and a second precast concrete column.

12. The method according to claim 9, wherein the at least one precast concrete column comprises a plurality of reinforcement members extending from the top surface of the at least one precast concrete column, and the plurality of reinforcement members are coupled to the precast concrete column cap.

13. The method according to claim 9, wherein the precast concrete column cap including at least one post-tensioning duct extending from the first side surface to the second side surface, wherein the precast concrete floor section includes at least one post- tensioning duct extending between the first side surface of the precast concrete floor section and the second side surface of the precast concrete floor section, the at least one post-tensioning duct of the precast concrete floor section being aligned with the at least one post-tensioning duct of the precast concrete column cap, and the method further comprises tensioning a post-tensioning tendon extending through the at least one post-tensioning duct of the precast concrete column cap and the at least one post-tensioning duct of the precast concrete floor section.

14. The method according to claim 9, wherein the at least one precast concrete column includes a support bracket, and a bottom surface of the precast concrete floor section is disposed on the support bracket.

15. The method according to claim 9, further comprising coupling a support beam to the at least one precast concrete column, and disposing a bottom surface of the precast concrete floor section on the support beam prior to coupling the precast concrete floor section to the precast concrete column cap.

16. The method according to claim 9, wherein the precast concrete column cap is a first precast concrete column cap and the at least one precast concrete column comprises a first precast concrete column and a second precast concrete column, and the method further comprises providing a third precast concrete column and a fourth precast concrete column, disposing a second precast concrete column cap on the top surface of the third precast concrete column and the fourth precast concrete column, and coupling the first side surface of the precast concrete floor section to the second side surface of the second precast concrete column cap.

* * * * *